United States Patent [19]

Kehl

[11] Patent Number: 4,738,358

[45] Date of Patent: Apr. 19, 1988

[54] PAINT ROLLER STORAGE CONTAINER AND EXTRACTOR

[76] Inventor: Charles W. Kehl, 11466 Irvington, Warren, Mich. 48093

[21] Appl. No.: 930,870

[22] Filed: Nov. 14, 1986

[51] Int. Cl.[4] ..... B05C 17/02; B65D 81/22

[52] U.S. Cl. ..... 206/207; 206/216; 206/361; 401/118

[58] Field of Search ..... 206/207, 209, 216, 361, 206/362.2, 362.3, 362, 446; 15/257 R; 68/213; 134/138, 149; 401/118, 119, 121, 122, 126, 127, 133

[56] References Cited

U.S. PATENT DOCUMENTS

| | | | |
|---|---|---|---|
| 2,234,089 | 3/1941 | Sanders | 206/446 |
| 2,551,710 | 5/1951 | Slaughter | 206/446 |
| 2,576,725 | 11/1951 | Schoelles | 206/446 |
| 2,704,931 | 3/1955 | Zelkowitz | 68/213 |
| 2,766,603 | 10/1956 | Zelkowitz | 68/213 |
| 3,406,812 | 10/1968 | Henry | 401/118 |
| 3,421,170 | 1/1969 | Thomas, Jr. | 15/104 A |
| 3,623,179 | 11/1971 | Roth | 15/104 A |
| 3,918,582 | 11/1975 | Wallace | 206/362 |
| 4,155,230 | 5/1979 | Lacher, Jr. | 68/213 |
| 4,334,416 | 6/1982 | Turano | 68/213 |
| 4,361,923 | 12/1982 | McKay | 15/104 A |
| 4,380,478 | 4/1983 | Cooney | 68/213 |
| 4,467,533 | 8/1984 | Sica | 206/361 |
| 4,469,223 | 9/1984 | Smith | 206/209 |
| 4,533,044 | 8/1985 | Ban | 206/362 |
| 4,541,542 | 9/1985 | Florentino | 401/118 |

FOREIGN PATENT DOCUMENTS

| | | | |
|---|---|---|---|
| 269307 | 12/1926 | United Kingdom | 220/356 |

*Primary Examiner*—Stephen Marcus

*Attorney, Agent, or Firm*—Harness, Dickey & Pierce

[57] ABSTRACT

A paint roller cover container and extractor assembly which simplifies the cleanup procedures when painting with a conventional paint roller. The container enables the roller cover to be stored therein and a core member is provided to displace the inside cavity of the roller cover. Once the roller cover and core are in position within the container, a small amount of paint or other liquid can be poured therein to saturate the roller cover. A sealing cap is put on the container to enclose it, thereby retaining the roller cover in a condition for reuse. Preferably, the container defines a plurality of radially inwardly deformed annular ribs which enable the container to be squeezed against the roller cover such that it is frictionally engaged, thereby enabling the associated roller handle portion to be withdrawn from the roller cover. The ribs also serve to centrally position the roller cover within the container, allowing liquid to be evenly distributed around the outer surface of the cover. An alternate embodiment is disclosed in which the core member is affixed to or formed integrally with the container.

8 Claims, 2 Drawing Sheets

PAINT ROLLER STORAGE CONTAINER AND EXTRACTOR

BACKGROUND AND SUMMARY OF THE INVENTION

This invention is related to a storage container and particularly to one adapted for extracting a used paint roller cover from the roller handle and storing the cover over extended periods in condition for reuse.

Anyone who has used conventional paint rollers for painting the exterior or interior surfaces of a house or another structure is well acquainted with the problems associated with cleanup of these devices once they are used. Typically, the roller cover must be carefully and thoroughly washed with water or organic solvents, depending on the type of paint. Cleaning a paint roller cover is a messy operation which is very time consuming. Moreover, even with one's best efforts, it is difficult or impossible to remove all the paint from the roller cover, and consequently, it becomes hardened after drying out which may produce unsatisfactory results when reused. In addition, once a roller cover has been used, it is normally removed from the roller handle which ordinarily requires the user to grasp the paint soaked cover to pull it free from the handle.

In view of the foregoing, it is an object of this invention to provide a container assembly which may be used to store a roller cover in condition for subsequent use. Another object of this invention is to greatly simplify or eliminate the cleanup chores for the paint roller cover. It is a further object of this invention to facilitate removal of a roller cover from the associated handle.

In accordance with this invention, the above objects are achieved by providing a container adapted to closely conform to a roller cover. The container further has means for displacing the volume within the inside cylindrical tube of the roller cover and has a sealing cap to enclose the container. Preferably, the container is used by depositing a used roller cover within the container and pouring a small amount of paint or other liquid directly into the container to maintain the cover in a saturated condition. Once the container is sealed, the roller cover remains ready for later use for an indefinite period of time. Since there is no need to remove paint from the roller cover, cleanup of the roller cover is practically eliminated. This invention further simplifies the method of extracting a paint roller handle from the roller cover. The container may be squeezed against the roller cover while the handle portion is pulled free, thus eliminating any dripping of liquids or getting paint on the user's hand, inasmuch as the operation would be done in the confines of the container.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE INVENTION

Figure 1:
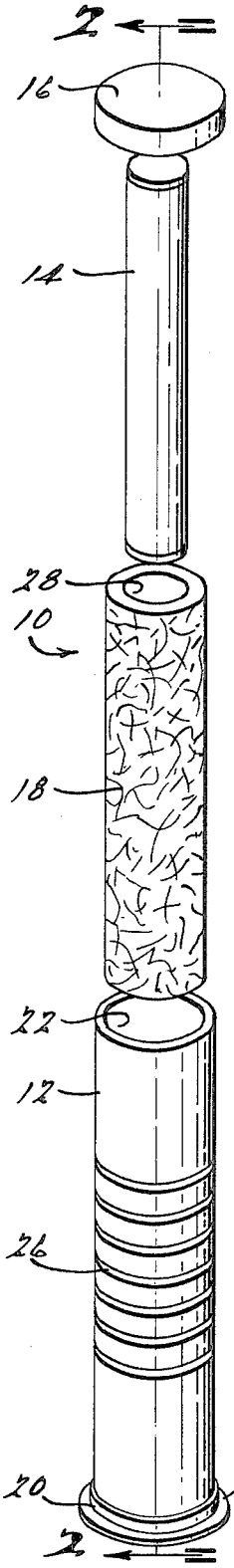
FIG. 1 is an exploded pictorial view showing a paint roller cover container and extractor assembly in accordance with a first embodiment of this invention shown with a paint roller cover.

FIG. 1 shows a paint roller cover container and extractor assembly in accordance with a first embodiment of this invention which is generally designated by reference number 10. Container and extractor assembly 10 generally comprises container 12, core 14 and cap 16, and is used with paint roller cover 18.

Container 12 is a generally cylindrical hollow tube having a closed bottom end 20 and an opened top end 22. Container 12 is preferably made of a polymeric plastic which is relatively flexible, thus enabling the container to be partially collapsed by a user when grasping the container from the sides. Bottom end 20 preferably defines radially outwardly projecting flange 24 which stabilizes container 12 when it is set in the erect position. Container 12 further forms several radially inwardly deformed annular ribs 26 which are located generally about the longitudinal center area of container 12. Preferably, the inside cylindrical surface of container 12 provides a slight radial clearance between it and roller cover 18.

Core member 14 is an enclosed tube which is adapted to be inserted within the cylindrical hollow cavity 28 of roller cover 18. Core 14 may be a unitary solid structure or may itself be defined by a hollow tube with a pair of end caps affixed thereto.

Cap 16 cooperates with top end 22 of container 12 to seal the container when it is used to store roller cover 18. Various conventional means for such attachment may be employed, such as cooperating interfitting flanges and grooves which enable the cap to sealingly engage with container 12 but which permits convenient removal of the cap.

Figure 2:
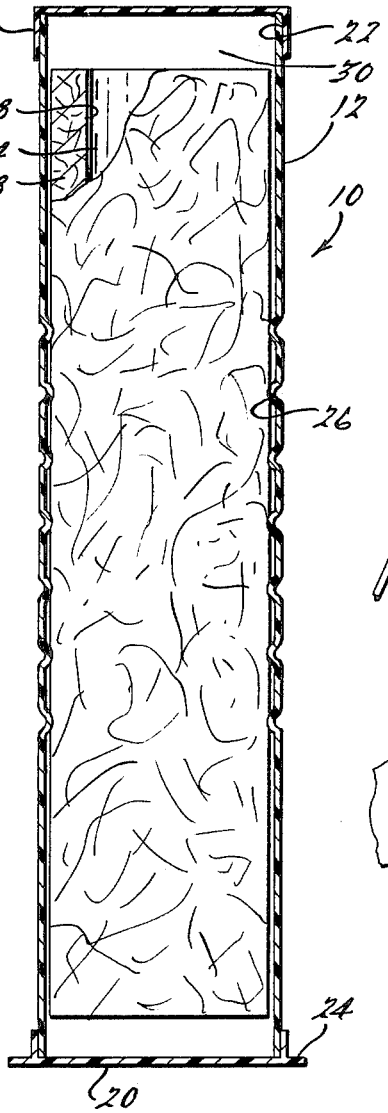
FIG. 2 is a cross-sectional view of the paint roller cover container and extractor assembly shown in FIG. 1 in an assembled configuration.

With reference to FIGS. 1 and 2, during use of assembly 10, roller cover 18 is placed into container 12. Core 14 is disposed within the inside cavity 28 of roller cover 18. Cap 16 seals the interior of container 12. As shown in FIG. 2, roller cover 18 preferably has an axial height which is somewhat less than that of the inside cavity of container 12, thereby leaving an empty space 30 above roller cover 18.

Figure 3:
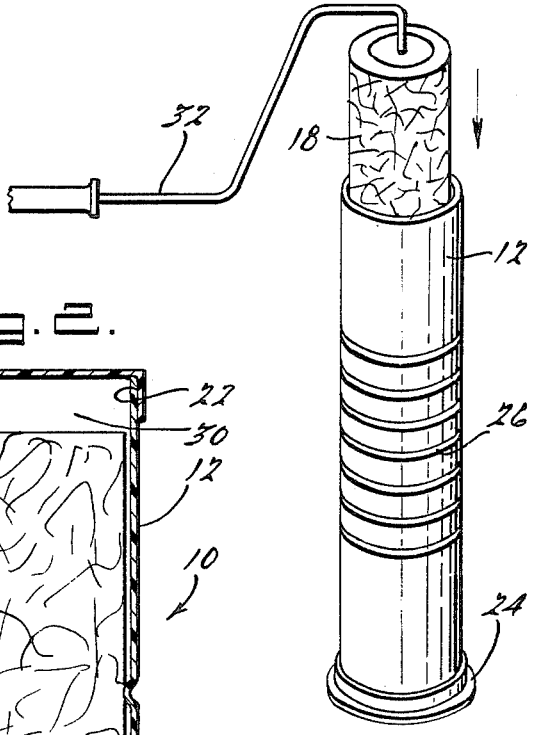
FIG. 3 shows a paint roller cover with its associated handle being inserted within the container shown in Figure 1.
Figure 4:
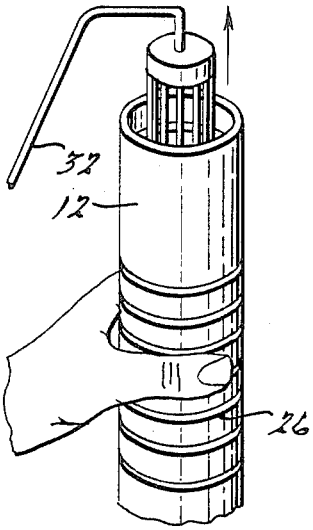
FIG. 4 is a partial pictorial view showing the paint roller cover handle being removed from the associated paint roller cover using the container and extractor assembly shown in FIG. 1.

Use of roller cover container and extractor assembly 10 will now be explained with particular reference to FIGS. 3 and 4. When the user desires to store roller cover 18, cap 16 and core 14 are removed from container 12 and the roller cover is inserted with its associated handle portion 32. Next, as shown in FIG. 4, the user grasps the outer surface of container 12 in the region of ribs 26 to frictionally engage roller cover 18, thereby enabling handle portion 32 to be axially withdrawn from the roller cover. Ribs 26 not only help engage cover 18, but further aid the user in grasping the outside surface of container 12 without slipping. Thereafter, core 14 is inserted within roller cover hollow cavity 28. In order to maintain roller cover 18 in a saturated condition ready for reuse, it is preferable for the user to pour a small amount of paint or other liquid within empty space 30 which will permeate and soak roller cover 18. Thereafter, cap 16 is snapped into place thus sealing the liquid within container 12 from the air to prevent cover 18 from drying out. Since core 14 displaces the internal volume of cavity 28, the amount of paint needed to saturate cover 18 is minimized. When cover 18 is placed in container 12, ribs 26 position the cover centrally within the container, thus allowing the liquid to be evenly distributed around the cover.

When the user desires to reuse roller cover 18, all that is required is to grasp container 12 firmly, remove cap 16, pour out the liquid and core 14, insert roller handle 32 and remove the cover. Cover 18 is then ready for reuse without spilling or getting paint on the user's hands.

A user may wish to have several paint roller cover container and extractor assemblies 10 on hand for various colors of paint. This system will practically eliminate the necessity for washing roller covers 18 following use. As a practical aid, the user can apply a small amount of paint to an outside surface of container 12 or cap 16 to indicate the color of paint which was used with the particular roller cover 18.

Figure 5:
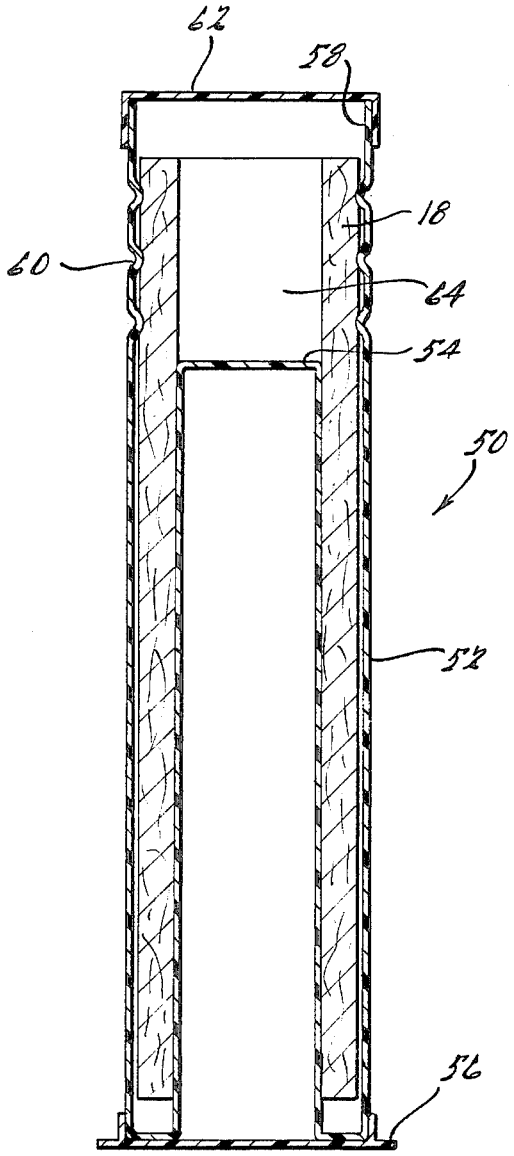
FIG. 5 is a cross-sectional view of a paint roller cover container and extractor assembly in accordance with the second embodiment of this invention.

A paint roller cover container and extractor assembly according to a second embodiment of this invention is shown in FIG. 5 and is generally designated by reference number 50. Container and extractor assembly 50 differs principally from assembly 10 according to the first embodiment in that a separate core member is eliminated. Instead, container 52 has core portion 54 attached thereto either as a separate component fused or bonded to container 52, or formed as an integral structure. Projecting flange 56 may be provided to steady assembly 50 during use. Core portion 54 preferably terminates below opened top end 58. Ribs 60 are provided in the uppermost portion of container 52. Cap 62 is used to enclose opened top end 58.

The manner of use of container and extractor assembly 50 varies somewhat from that of assembly 10 since it does not have a separable core member. When it is desirable to place roller cover 18 into assembly 50, cap 62 is removed and the cover 18 with handle portion 32 is inserted within the upper opened cavity area 64 formed above core portion 54. In this position, the user grasps container 52 in the region of rib 60 and withdraws handle portion 32 from roller cover 18. Thereafter, the user releases pressure on container 52 and roller cover 18 falls to its final position shown in FIG. 5. Thereafter, paint or another liquid is poured into container 54 to fill opened cavity 64.

Assembly 50 requires more liquid to be poured into the container as compared with the first embodiment and does not fully enclose the roller cover 18 during the extraction process. However, this embodiment possesses the advantage that core portion 54 is not a separate component but may be integrally formed with the remainder of container 52, for example, by injection molding.

A further variation on assembly 50 would include continuing core portion 54 upwardly to completely fill the interior cavity portion of container 52. Such a modified container could not be used as an extractor since it would not be possible to insert roller cover 18 with handle portion 32 in place into the container. Such a device would, however, be usable as a container which would maintain roller cover 18 in a moistened condition ready for later use.

While the above description constitutes the preferred embodiments of the present invention, it will be appreciated that the invention is susceptible to modification, variation and change without departing from the proper scope and fair meaning of the accompanying claims.

What is claimed is:

1. A paint roller cover container and extractor assembly for storing a paint roller cover having a hollow inside cavity in a bath of paint thereby enabling said roller cover to be reused without cleaning and for extracting a roller handle from said cover, said assembly comprising:

a cylindrical container for storing said roller cover having a closed end and an opened end and having a diameter closely conforming to the outside diameter of said roller cover and further having a plurality of radially inward projections for engaging said roller cover enabling said roller handle to be removed from said container when a user grasps said container, thereby causing said container to collapse against said roller cover such that said projections engage said roller cover, core member means for insertion inside said roller cover inside cavity for substantially displacing the volume therein, and a cap member for enclosing said container opened end such that said container is sealed wherein when said roller cover is disposed in said container and said core means is disposed inside said cover, liquid paint may be poured into said container completely immersing said roller cover such that when said cap member encloses said container opened end, said roller cover is maintained in a moistened state ready for reuse, said core member means and said container diameter serving to reduce the volume of paint within said container necessary to immerse said roller cover within said paint.

2. The paint roller cover container and extractor assembly according to claim 1 wherein said radially inward projections are a plurality of circumferential ribs.

3. The paint roller cover container assembly according to claim 1 wherein said core means is affixed to said container closed end and terminates within said container to define an open cavity within said container adjacent said container opened end.

4. The paint roller cover container assembly according to claim 3 wherein said projections are formed adjacent of said container open cavity.

5. The paint roller cover container assembly according claim 1 wherein said core means is formed integrally with said container means.

6. A method of maintaining a paint roller cover in a moistened state ready for reuse by storing said roller cover immersed within a bath of paint, said method comprising the steps of:

providing a cylindrical container having a closed end and an opened end and having a diameter closely conforming to the outside diameter of said roller cover and having radially inward projections for engaging said roller cover, providing core means for substantially displacing the volume of the inside cavity of the roller cover, providing a cap member for enclosing said container opened end thereby sealing said container, placing said roller cover into said container by compressing said container against said roller cover while withdrawing a roller handle from said roller cover, pouring paint into said container to completely immerse said roller cover, and placing said cap member onto said container opened end thereby sealing said container and maintaining said roller cover in condition for subsequent reuse.

7. The method according to claim 6 wherein said core means comprises a core member separate from said container and wherein the method further comprises the steps of:

placing said core member within said cover inside cavity after said cover is placed inside said container.

8. The method according to claim 7 further comprising the steps of removing said roller cover from said container by removing said core member and thereafter inserting the roller handle into said cover inside cavity and removing said roller cover and said roller handle in an assembled condition.

* * * * *